US008109157B2

(12) United States Patent
Kanayama et al.

(10) Patent No.: US 8,109,157 B2
(45) Date of Patent: Feb. 7, 2012

(54) METHODS AND APPARATUS OF DOWNHOLE FLUIDS ANALYSIS

(75) Inventors: Kazumasa Kanayama, Kanagawa-Ken (JP); Tsuyoshi Yanase, Tokyo (JP); Sihar Marpaung, Kanagawa-Ken (JP)

(73) Assignee: Schlumberger Technology Corporation, Sugar Land, TX (US)

( * ) Notice: Subject to any disclaimer, the term of this patent is extended or adjusted under 35 U.S.C. 154(b) by 832 days.

(21) Appl. No.: 12/165,523

(22) Filed: Jun. 30, 2008

(65) Prior Publication Data

US 2009/0321072 A1 Dec. 31, 2009

(51) Int. Cl.
*G01N 30/20* (2006.01)

(52) U.S. Cl. ..... 73/863.72

(58) Field of Classification Search ..... None
See application file for complete search history.

(56) References Cited

U.S. PATENT DOCUMENTS

| | | | | | |
|---|---|---|---|---|---|
| 3,084,554 | A | * | 4/1963 | Perilloux | 73/863.73 |
| 3,104,713 | A | * | 9/1963 | Lebourg | 166/142 |
| 3,318,154 | A | * | 5/1967 | Rendina | 73/863.73 |
| 3,347,269 | A | * | 10/1967 | Courneya et al. | 137/625.48 |
| 3,611,799 | A | * | 10/1971 | Davis | 73/152.24 |
| 3,780,575 | A | | 12/1973 | Urbanoski | |
| 3,858,450 | A | * | 1/1975 | Jones | 73/863.72 |
| 3,859,851 | A | | 1/1975 | Urbanoski | |
| 4,712,434 | A | * | 12/1987 | Herwig et al. | 73/864.63 |
| 4,860,581 | A | | 8/1989 | Zimmerman | |
| 4,994,671 | A | | 2/1991 | Safinya | |
| 5,167,149 | A | | 12/1992 | Mullins | |
| 5,201,220 | A | | 4/1993 | Mullins | |
| 5,266,800 | A | | 11/1993 | Mullins | |
| 5,331,156 | A | | 7/1994 | Hines | |
| 6,476,384 | B1 | | 11/2002 | Mullins | |
| 6,758,090 | B2 | | 7/2004 | Bostrom | |
| 2002/0194906 | A1 | | 12/2002 | Goodwin | |
| 2004/0000636 | A1 | | 1/2004 | Mullins | |
| 2006/0243033 | A1 | | 11/2006 | Freemark | |
| 2006/0243047 | A1 | | 11/2006 | Terabayashi | |
| 2007/0035736 | A1 | | 2/2007 | Vannuffelen | |

FOREIGN PATENT DOCUMENTS

| | | | |
|---|---|---|---|
| GB | 2435283 | A | 8/2007 |

* cited by examiner

*Primary Examiner* — Robert Raevis

(74) *Attorney, Agent, or Firm* — Daryl R. Wright; Jody DeStefanis; Jeff Griffin

(57) ABSTRACT

A fluid sampling and analysis module for a downhole fluid characterization apparatus configured for operation downhole, within a borehole. The fluid sampling and analysis module comprises a primary flowline for fluids withdrawn from a formation to flow through the fluid sampling and analysis module, a bypass flowline in fluid communication with the primary flowline and a single valve, interconnecting the primary flowline and the bypass flowline, operable to a first position for formation fluids to flow in the primary flowline and to a second position for formation fluids to flow, via the bypass flowline, in the primary flowline.

16 Claims, 11 Drawing Sheets

Sample replacing

Captured sample

METHODS AND APPARATUS OF DOWNHOLE FLUIDS ANALYSIS

CROSS REFERENCE TO RELATED APPLICATIONS

This application is related to co-pending and commonly owned U.S. patent application Ser. No. 11/203,932, filed Aug. 15, 2005, entitled "Methods and Apparatus of Downhole Fluid Analysis" and Ser. No. 11/858,138, filed Sep. 20, 2007, entitled "Circulation Pump for Circulating Downhole Fluids, and Characterization Apparatus of Downhole Fluids", the entire contents of which are incorporated herein by reference.

FIELD

The present invention relates to the field of sampling and analysis of downhole fluids of a geological formation for evaluating and testing the formation for purposes of exploration and development of hydrocarbon-producing wells, such as oil or gas wells. More particularly, the present disclosure is directed to methods and apparatus utilizing a downhole fluid sampling and analysis apparatus that is configured or designed for capturing formation fluids in a portion of a flowline utilizing, in part, a single valve apparatus, and characterizing the fluids downhole.

BACKGROUND

Downhole fluid sampling and analysis is an important and efficient investigative technique typically used to ascertain characteristics and nature of geological formations having hydrocarbon deposits. In this, typical oilfield exploration and development includes downhole fluid sampling and analysis for determining petrophysical, mineralogical, and fluid properties of hydrocarbon reservoirs. Fluid characterization is integral to an accurate evaluation of the economic viability of a hydrocarbon reservoir formation.

Typically, a complex mixture of fluids, such as oil, gas, and water, is found downhole in reservoir formations. The downhole fluids, which are also referred to as formation fluids, have characteristics, including pressure, temperature, volume, among other fluid properties, that determine phase behavior of the various constituent elements of the fluids. In order to evaluate underground formations surrounding a borehole, it is often desirable to obtain samples of formation fluids in the borehole for purposes of characterizing the fluids, including composition analysis, fluid properties and phase behavior. Wireline formation testing tools are disclosed, for example, in U.S. Pat. Nos. 3,780,575 and 3,859,851, and the Reservoir Formation Tester (RFT) and Modular Formation Dynamics Tester (MDT) of Schlumberger are examples of sampling tools for extracting samples of formation fluids from a borehole for surface analysis.

Formation fluids under downhole conditions of composition, pressure and temperature typically are different from the fluids at surface conditions. For example, downhole temperatures in a well could range from 300 degrees F. When samples of downhole fluids are transported to the surface, change in temperature of the fluids tends to occur, with attendant changes in volume and pressure. The changes in the fluids as a result of transportation to the surface cause phase separation between gaseous and liquid phases in the samples, and changes in compositional characteristics of the formation fluids.

Techniques also are known to maintain pressure and temperature of samples extracted from a well so as to obtain samples at the surface that are representative of downhole formation fluids. In conventional systems, samples taken downhole are stored in a special chamber of the formation tester tool, and the samples are transported to the surface for laboratory analysis. During sample transfer from below surface to a surface laboratory, samples often are conveyed from one sample bottle or container to another bottle or container, such as a transportation tank. In this, samples may be damaged during the transfer from one vessel to another.

Furthermore, sample pressure and temperature frequently change during conveyance of the samples from a wellsite to a remote laboratory despite the techniques used for maintaining the samples at downhole conditions. The sample transfer and transportation procedures currently in use are known to damage or spoil formation fluid samples by bubble formation, solid precipitation in the sample, among other difficulties associated with the handling of formation fluids for surface analysis of downhole fluid characteristics.

In addition, laboratory analysis at a remote site is time consuming. Delivery of sample analysis data takes anywhere from a couple of weeks to months for a comprehensive sample analysis. This hinders the ability to satisfy users' demand for real-time results and answers (i.e., answer products). Typically, the time frame for answer products relating to surface analysis of formation fluids is a few months after a sample has been sent to a remote laboratory.

As a consequence of the shortcomings in surface analysis of formation fluids, recent developments in downhole fluid sampling and analysis include techniques for isolating and characterizing formation fluids downhole in a wellbore or borehole. In this, the MDT may include one or more fluid analysis modules, such as the Composition Fluid Analyzer (CFA) and Live Fluid Analyzer (LFA) of Schlumberger, for example, to analyze downhole fluids sampled by the tool while the fluids are still located downhole.

In downhole fluid sampling and analysis modules of the type described above, formation fluids that are to be sampled and analyzed downhole flow past a sensor module associated with the fluid sampling and analysis module, such as a spectrometer module, which analyzes the flowing fluids by infrared absorption spectroscopy, for example. In this, an Optical Fluid Analyzer (OFA), which may be located in the fluid analysis module, may identify fluids in the flow stream and quantify the oil and water content. U.S. Pat. No. 4,994,671 (incorporated herein by reference in its entirety) describes a borehole apparatus having a testing chamber, a light source, a spectral detector, a database, and a processor. Fluids drawn from the formation into the testing chamber are analyzed by directing the light at the fluids, detecting the spectrum of the transmitted and/or backscattered light, and processing the information (based on information in the database relating to different spectra), in order to characterize the formation fluids.

In addition, U.S. Pat. Nos. 5,167,149 and 5,201,220 (both incorporated herein by reference in their entirety) describe apparatus for estimating the quantity of gas present in a fluid stream. A prism is attached to a window in the fluid stream and light is directed through the prism to the window. Light reflected from the window/fluid flow interface at certain specific angles is detected and analyzed to indicate the presence of gas in the fluid flow.

As set forth in U.S. Pat. No. 5,266,800 (incorporated herein by reference in its entirety), monitoring optical absorption spectrum of fluid samples obtained over time may allow one to determine when formation fluids, rather than mud filtrates, are flowing into the fluid analysis module. Further, as described in U.S. Pat. No. 5,331,156 (incorporated herein by reference in its entirety), by making optical density (OD) measurements of the fluid stream at certain predetermined energies, oil and water fractions of a two-phase fluid stream may be quantified.

Conventionally, multiple valves are utilized in downhole fluid sampling and analysis modules of the type described above to control flow of formation fluids through the flowlines of the fluid analysis modules. For example, co-pending and commonly owned U.S. patent application Ser. No. 11/203,932, filed Aug. 15, 2005, entitled "Methods and Apparatus of Downhole Fluid Analysis", discloses the use of a plurality of valves for isolating formation fluids in a part of the flowline of a downhole sampling and analysis module. FIG. 7 schematically represents one example of a fluid sampling and analysis module with a flowline and multiple valve configuration for downhole characterization of fluids by isolating or capturing the formation fluids. In systems of the type depicted in FIG. 7, motors are provided downhole to actuate the valves, and a driver board is configured to control operation of the valves and associated motors. Typically, seal valves are employed for purposes of opening or closing the flowlines. The seal valves also may be used for directing fluids through the fluid sampling and analysis module.

The fluid control systems of the type described above have multiple components and operating parts, and require space in the downhole modules. In consequence, there is a need for a simple, yet reliable, fluid control system that provides the functionality described above, yet requires minimal space and downhole hardware for its operations.

SUMMARY

In consequence of the background discussed above, and other factors that are known in the field of downhole fluid sampling and analysis, applicants discovered methods and apparatus for downhole characterization of formation fluids by isolating the fluids from the formation and/or borehole in a flowline of a fluid sampling and analysis module. In some embodiments of the present disclosure, the fluids are isolated with a single valve flow control system that is integrated with the primary flowline and characteristics of the isolated fluids are determined utilizing, in part, a pressure and volume control unit (PVCU).

The applicants further discovered that when the isolated fluid sample is circulated in a closed loop line, accuracy of phase behavior measurements can be improved. Therefore, in order to circulate the sample in a closed loop line, a circulation pump is provided in the flowline of the apparatus.

According to one aspect of the present disclosure, there is provided a downhole fluid characterization apparatus configured for operation downhole, within a borehole. The apparatus includes a fluid sampling and analysis module having a primary flowline with a first end for formation fluids to enter and a second end for the fluids to exit the fluid sampling and analysis module. A bypass flowline in fluid communication with the primary flowline is provided, and a fluid control system interconnecting the primary flowline and the bypass flowline. The fluid control system has a first position interconnecting a first port of the primary flowline with a second port of the primary flowline for formation fluids to flow in the primary flowline, and a second position interconnecting the first port of the primary flowline with a first port of the bypass flowline and the second port of the primary flowline with a second port of the bypass flowline for formation fluids to flow, via the bypass flowline, in the primary flowline, wherein fluid flow in the primary flowline is maintained during operation of the fluid control system between the first position and the second position. In aspects of the present disclosure, in the first position of the fluid control system, the bypass flowline comprises a circulation flowline for captured formation fluids to circulate in a closed loop of the circulation flowline.

In other aspects herein, the fluid sampling and analysis module includes a circulation pump for circulating captured formation fluids in the closed loop of the circulation flowline. In other embodiments, the fluid sampling and analysis module includes at least one first sensor structured and arranged for measuring parameters of interest downhole, within a borehole, wherein the parameters of interest relate to captured formation fluids in the circulation flowline, and the at least one first sensor comprising one or more of a density/viscosity sensor; a pressure sensor; and an imager. In yet other aspects herein, the fluid sampling and analysis module includes a pump unit in fluid communication with the bypass flowline for varying pressure and volume of captured fluids.

Aspects of the present disclosure include a pressure compensation unit associated with the fluid control system, the pressure compensation unit being structured and arranged for balancing pressure at opposite ends of the fluid control system to borehole pressure. The fluid sampling and analysis module may further comprise a plurality of sensors structured and arranged for measuring parameters of interest relating to fluids withdrawn from the formation. The fluid control system may comprise a shaft structured and arranged for longitudinal movement in a housing; the shaft having a through hole extending longitudinally and three orifices; an annular space between the shaft and the housing, and four seals attached to the shaft in the annular space between the shaft and the housing, wherein the shaft and the inner wall of the housing being shaped so that in combination with the three orifices, through hole and annular space between the shaft and the housing fluid flow in the primary flowline is not blocked during operation of the fluid control system between the first position and the second position.

In certain embodiments, a tool configured to be located downhole for sampling and characterizing formation fluids located downhole in an oilfield reservoir includes a fluid analysis module, the fluid analysis module having a flowline for fluids withdrawn from a formation to flow through the fluid analysis module, the flowline having a first end for the fluids to enter and a second end for the fluids to exit the fluid analysis module; the flowline comprising a primary flowline and a bypass flowline; and the fluid analysis module further comprising a single valve interconnecting the primary flowline and the bypass flowline, the single valve being operable to a first position for formation fluids to flow in the primary flowline, and to a second position for formation fluids to flow, via the bypass flowline, in the primary flowline, wherein the bypass flowline comprises a closed loop flowline for captured fluids when the valve is in the first position.

In yet other embodiments, fluid flow in the primary flowline is maintained during operation of the valve between the first and the second positions. The fluid analysis module may further comprise a pressure compensation unit structured and arranged for balancing pressure at opposite ends of the valve so that operation of the valve between the first and the second positions is at a balanced borehole pressure.

Aspects herein provide a fluid flow control system structured to control flow of downhole fluids through a fluid sampling and analysis module configured for operation downhole, within a borehole, the fluid sampling and analysis module comprising a primary flowline and a bypass flowline, in fluid communication with the primary flowline, for downhole fluids withdrawn from a formation to flow through the fluid sampling and analysis module, the primary flowline having a first end for the fluids to enter and a second end for the fluids to exit the fluid sampling and analysis module. The fluid flow control system comprises a movable shaft configured and designed for operation downhole, within a borehole, the movable shaft being operable to selectively interconnect the primary flowline and the bypass flowline of the fluid sampling and analysis module, wherein the movable shaft has a first operating position interconnecting a first port of the primary flowline with a second port of the primary flowline, and a second operating position interconnecting the first port of the primary flowline with a first port of the bypass flowline and the second port of the primary flowline with a second port of the bypass flowline, wherein in the first position of the movable shaft downhole fluids flow in the primary flowline, and in the second position of the moveable shaft downhole fluids flow, via the bypass flowline, in the primary flowline; and fluid flow in the primary flowline is maintained during operation of the movable shaft between the first and the second operating positions.

In aspects herein, the fluid flow control system may include a housing; the movable shaft being structured and arranged in the housing for movement thereof in a longitudinal direction, wherein the movable shaft has a central through hole through which the downhole fluids flow in a longitudinal direction thereof; an annular space between an outer surface of the movable shaft and an inner surface of the housing; and three orifices for directing flow of downhole fluids in the primary flowline and the bypass flowline, wherein the shaft and the inner wall of the housing being shaped so that in combination with the three orifices, through hole and annular space between the shaft and the housing fluid flow in the primary flowline is not blocked during movement of the fluid control system between the first and the second operating positions. A pressure compensation unit is structured and arranged for balancing pressure at opposite ends of the movable shaft so that operation of the moveable shaft between the first and the second operating positions is at a balanced borehole fluid pressure.

Certain embodiments herein provide a method of downhole characterization of formation fluids utilizing a downhole tool comprising a fluid sampling and analysis module having a primary flowline, a bypass flowline and a single valve configured and designed for selectively interconnecting the primary flowline and the bypass flowline for flowing formation fluids through the fluid sampling and analysis module and for capturing formation fluids in a closed loop of the bypass flowline, the method comprising setting the valve in a first operating position so that formation fluids flow through the primary flowline; monitoring at least a first parameter of interest relating to formation fluids flowing in the primary flowline; when a predetermined criterion for the first parameter of interest is satisfied, setting the valve in a second operating position so that formation fluids flow, via the bypass flowline, in the primary flowline; capturing formation fluids in the closed loop of the bypass flowline by returning the valve to the first operating position; balancing pressure at opposite ends of the valve so that operation of the valve between the first and the second operating positions is at a balanced fluid pressure; and characterizing captured formation fluids by operation of one or more sensor structured and arranged on the bypass flowline.

In certain embodiments, a method includes characterizing captured formation fluids includes determining one or more fluid property of the captured fluids. In other aspects the method includes determining one or more fluid property comprises changing fluid pressure of the captured formation fluids by varying volume of the captured fluids before determining one or more fluid property. One or more fluid property may be determined after changing fluid pressure.

Additional advantages and novel features of the present disclosure will be set forth in the description which follows or may be learned by those skilled in the art through reading the materials herein or practicing the invention. The advantages of the invention may be achieved through the means recited in the attached claims.

BRIEF DESCRIPTION OF THE DRAWINGS

The accompanying drawings illustrate some of the embodiments disclosed herein and are a part of the specification. Together with the following description, the drawings demonstrate and explain principles of the present disclosure.

Figure 1:
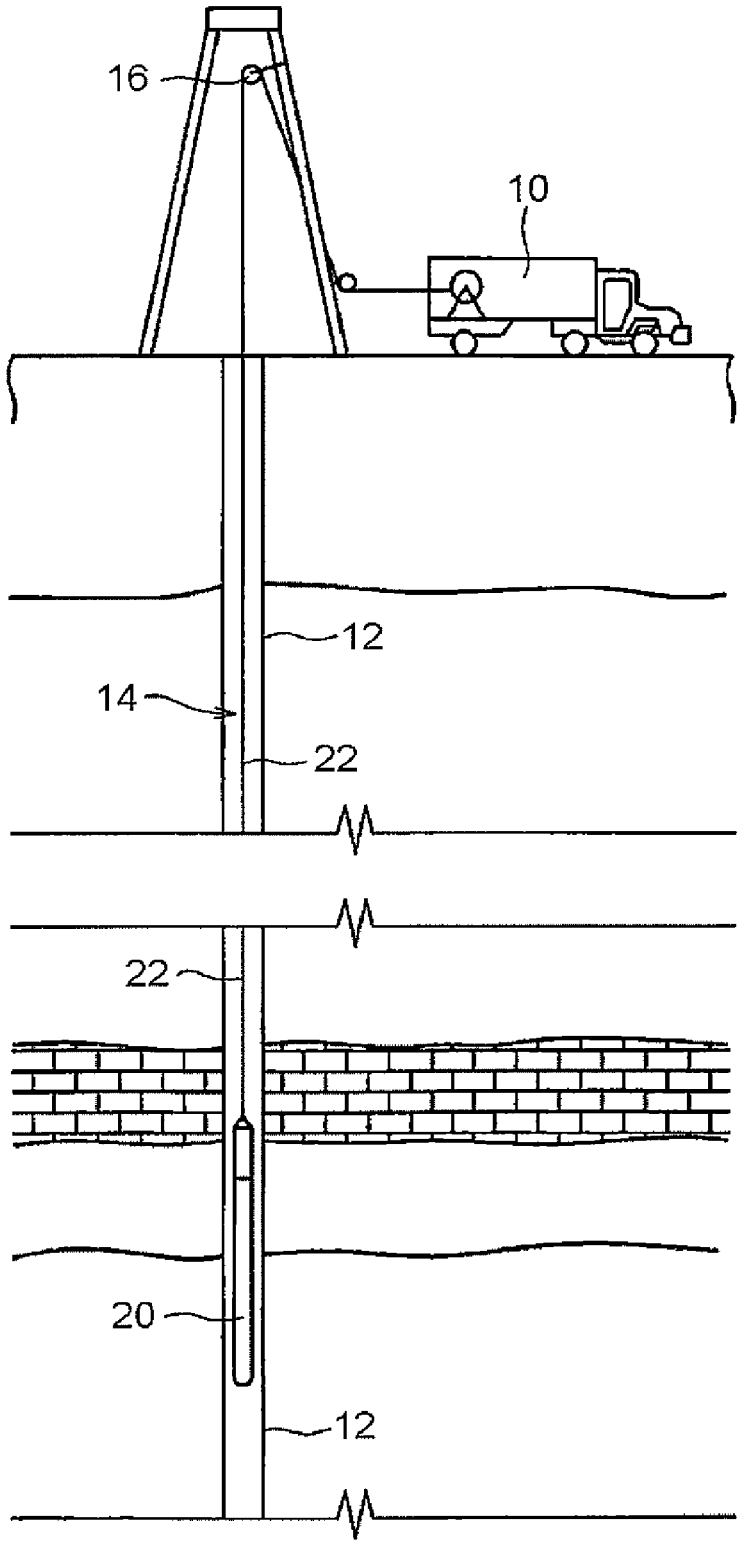
FIG. 1 is a schematic representation in cross-section of an exemplary operating environment of the methods and apparatus of the present disclosure.

Throughout the drawings, identical reference numbers indicate similar, but not necessarily identical elements. While the present disclosure is susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents and alternatives falling within the scope of the invention as defined by the appended claims.

DETAILED DESCRIPTION

Illustrative embodiments and aspects of the present disclosure are described below. In the interest of clarity, not all features of an actual implementation are described in the specification. It will of course be appreciated that in the development of any such actual embodiment, numerous implementation-specific decisions must be made to achieve the developers' specific goals, such as compliance with system-related and business-related constraints, that will vary from one implementation to another. Moreover, it will be appreciated that such development effort might be complex and time-consuming, but would nevertheless be a routine undertaking for those of ordinary skill in the art having benefit of the disclosure herein.

The present disclosure is applicable to oilfield exploration and development in areas such as downhole fluid sampling and analysis using one or more fluid sampling and analysis modules in Schlumberger's Modular Formation Dynamics Tester (MDT), for example.

FIG. 1 is a schematic representation in cross-section of an exemplary operating environment of the present disclosure wherein a service vehicle 10 is situated at a wellsite having a borehole or wellbore 12 with a borehole tool 20 suspended therein at the end of a wireline 22. FIG. 1 depicts one possible setting, and other operating environments also are contemplated by the present disclosure. Typically, the borehole 12 contains a combination of fluids such as water, mud filtrate, formation fluids, etc. The borehole tool 20 and wireline 22 typically are structured and arranged with respect to the service vehicle 10 as shown schematically in FIG. 1, in an exemplary arrangement.

Figure 2:
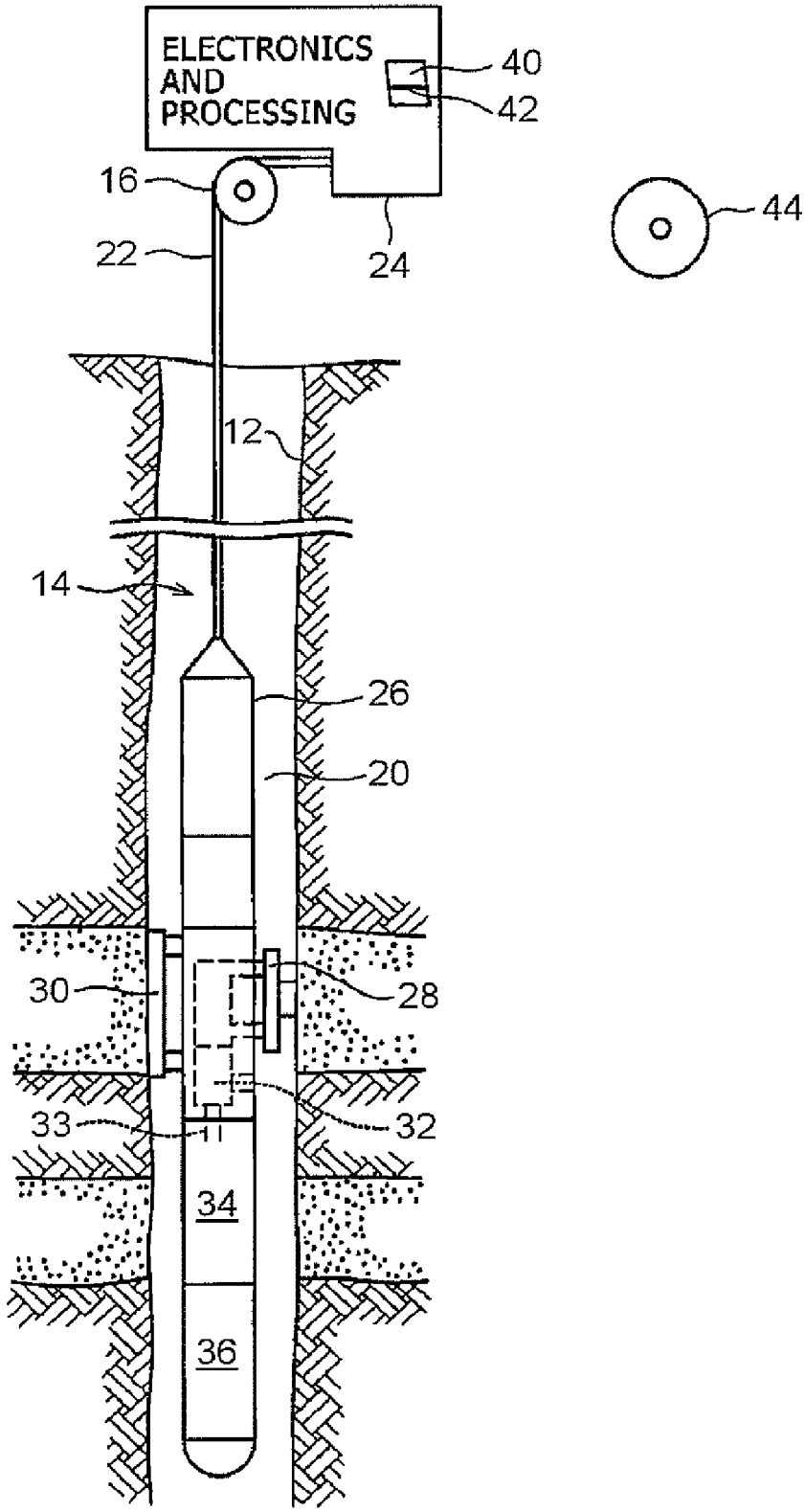
FIG. 2 is a schematic representation of one embodiment of a system for downhole sampling and analysis of formation fluids according to the present disclosure with an exemplary tool string deployed in a wellbore.

FIG. 2 is an exemplary embodiment of a system 14 for downhole analysis and sampling of formation fluids according to the one possible embodiment of the present disclosure, for example, while the service vehicle 10 is situated at a wellsite (note FIG. 1). In FIG. 2, a borehole system 14 includes a borehole tool 20, which may be used for testing earth formations and analyzing the composition of fluids from a formation. The borehole tool 20 typically is suspended in the borehole 12 (note also FIG. 1) from the lower end of a multiconductor logging cable or wireline 22 spooled on a winch 16 (note again FIG. 1) at the formation surface. The logging cable 22 typically is electrically coupled to a surface electrical control system 24 having appropriate electronics and processing systems for the borehole tool 20.

Figure 3:
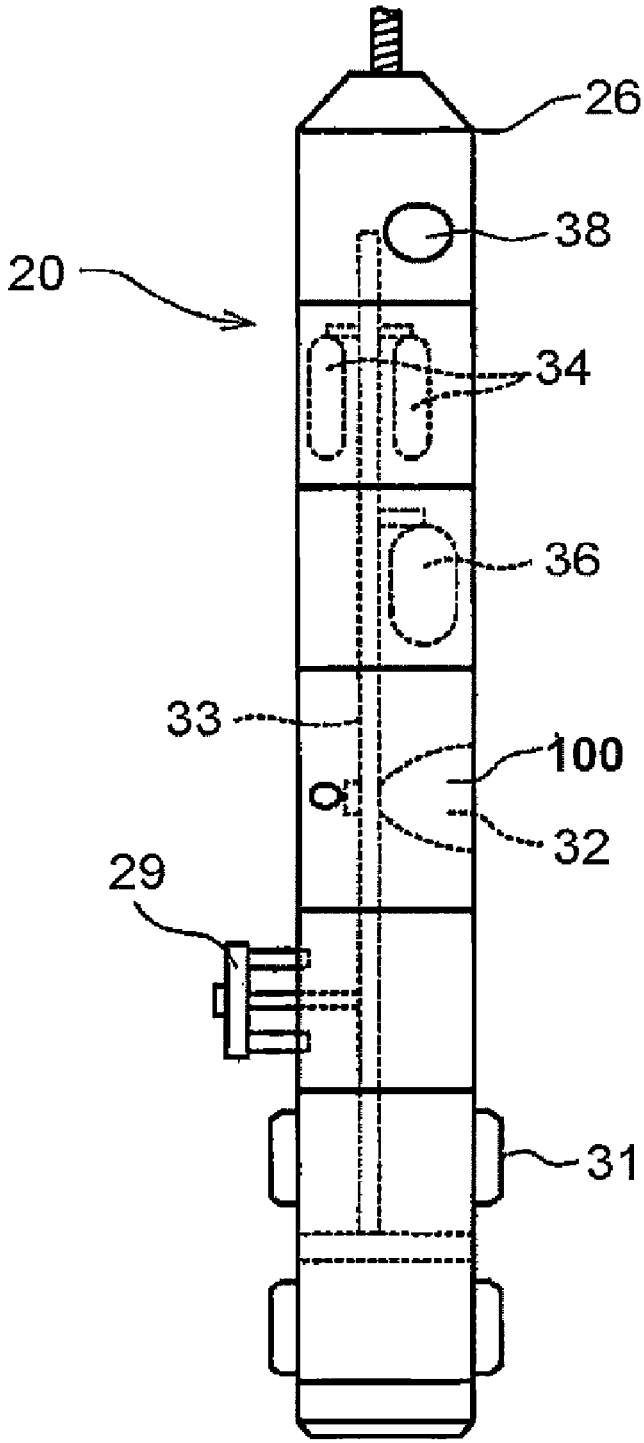
FIG. 3 shows schematically one embodiment of a tool string according to the present disclosure with a fluid sampling and analysis module having a flowline and fluid flow control system for downhole sampling and analysis of formation fluids.

Referring also to FIG. 3, the borehole tool 20 includes an elongated body 26 encasing a variety of electronic components and modules, which are schematically represented in FIGS. 2 and 3, for providing necessary and desirable functionality to the borehole tool 20. A selectively extendible fluid admitting assembly 28 and a selectively extendible tool-anchoring member 30 (note FIG. 2) are respectively arranged on opposite sides of the elongated body 26. Fluid admitting assembly 28 is operable for selectively sealing off or isolating selected portions of a borehole wall 12 such that pressure or fluid communication with adjacent earth formation is established. The fluid admitting assembly 28 may be a single probe module 29 (depicted in FIG. 3) and/or a packer module 31 (also schematically represented in FIG. 3). Examples of borehole tools are disclosed in the aforementioned U.S. Pat. Nos. 3,780,575 and 3,859,851, and in U.S. Pat. No. 4,860,581, the contents of which are incorporated herein by reference in their entirety.

One or more fluid sampling and analysis modules 32 are provided in the tool body 26. Fluids obtained from a formation and/or borehole flow through a flowline 33, via the fluid analysis module or modules 32, and then may be discharged through a port of a pumpout module 38 (note FIG. 3). Alternatively, formation fluids in the flowline 33 may be directed to one or more fluid collecting chambers 34 and 36, such as 1, 2¾, or 6 gallon sample chambers and/or six 450 cc multi-sample modules, for receiving and retaining the fluids obtained from the formation for transportation to the surface. Examples of the fluid sampling and analysis modules 32 are disclosed in U.S. Patent Application Publications Nos. 2006/0243047A1 and 2006/0243033A1, both incorporated herein by reference in their entirety.

The fluid admitting assemblies, one or more fluid analysis modules, the flow path and the collecting chambers, and other operational elements of the borehole tool 20, are controlled by electrical control systems, such as the surface electrical control system 24 (note FIG. 2). The electrical control system 24, and other control systems situated in the tool body 26, for example, may include processor capability for characterization of formation fluids in the tool 20, as described in more detail below.

The system 14, in its various embodiments, may include a control processor 40 operatively connected with the borehole tool 20. The control processor 40 is depicted in FIG. 2 as an element of the electrical control system 24. Methods disclosed herein may be embodied in a computer program that runs in the processor 40 located, for example, in the control system 24. In operation, the program is coupled to receive data, for example, from the fluid sampling and analysis module 32, via the wireline cable 22, and to transmit control signals to operative elements of the borehole tool 20.

The computer program may be stored on a computer usable storage medium 42 associated with the processor 40, or may be stored on an external computer usable storage medium 44 and electronically coupled to processor 40 for use as needed. The storage medium 44 may be any one or more of presently known storage media, such as a magnetic disk fitting into a disk drive, or an optically readable CD-ROM, or a readable device of any other kind, including a remote storage device coupled over a switched telecommunication link, or future storage media suitable for the purposes and objectives described herein.

In some embodiments of the present disclosure, the methods and apparatus disclosed herein may be embodied in one or more fluid sampling and analysis modules of Schlumberger's formation tester tool, the Modular Formation Dynamics Tester (MDT). In this, a formation tester tool, such as the MDT, may be provided with enhanced functionality for the downhole characterization of formation fluids and the collection of formation fluid samples. The formation tester tool may be used for sampling formation fluids in conjunction with downhole characterization of the formation fluids.

Figure 4A:
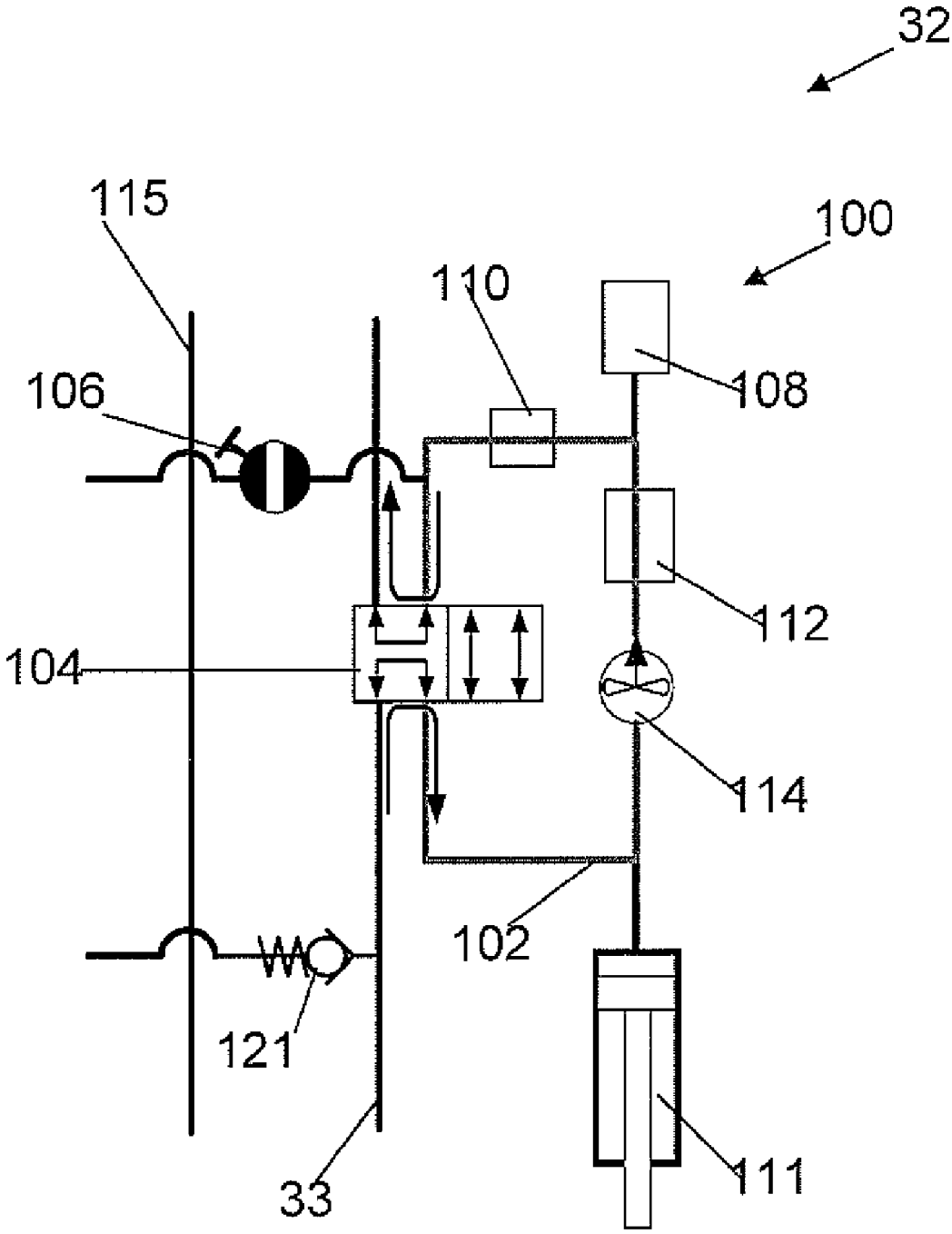
FIG. 4A schematically represents one fluid sampling and analysis module with a flowline and single valve apparatus configuration according to one embodiment of the present disclosure for downhole characterization of fluids by isolating or capturing the formation fluids.
Figure 4B:
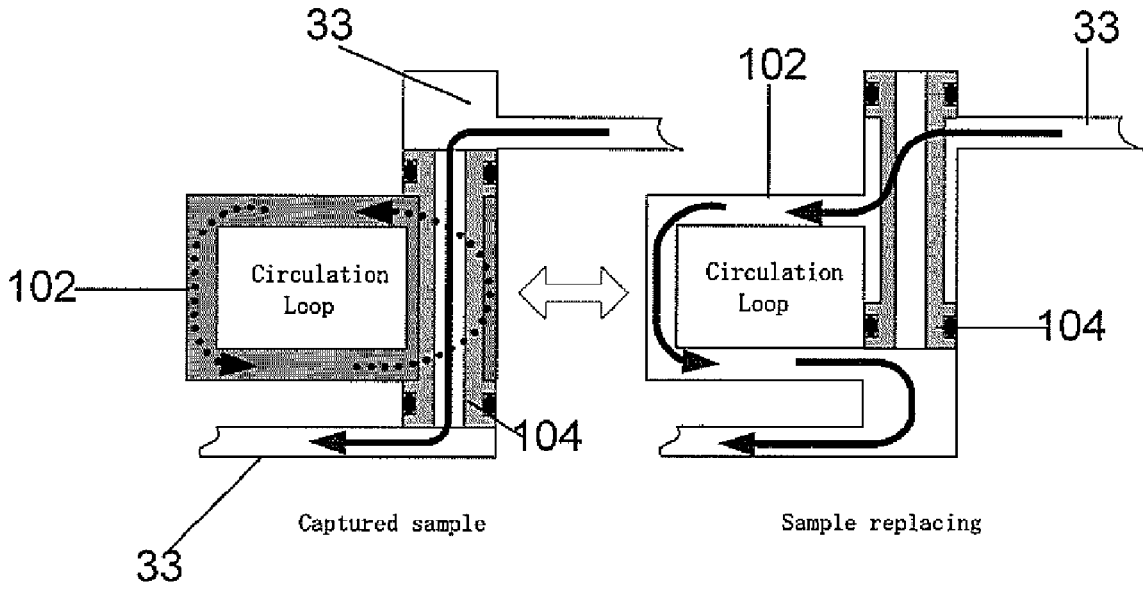
FIG. 4B is a schematic depiction of the operations of a flowline and single valve apparatus configuration according to the present disclosure.

FIG. 4A schematically represents one fluid sampling and analysis module with a flowline and single valve apparatus configuration according to one embodiment of the present disclosure for downhole characterization of fluids by isolating or capturing the formation fluids. FIG. 4B is a schematic depiction of the operations of a flowline and single valve apparatus configuration according to one embodiment of FIG. 4A.

In FIG. 4A, a fluid sampling and analysis module 32 has a flowline and single valve apparatus 100 for downhole characterization of fluids by isolating or capturing the formation fluids (note also FIG. 3). In some embodiments, the apparatus 100 of FIG. 4A may be integrated with the primary flowline 33 of the module 32. The apparatus 100 includes a bypass flowline 102 in fluid communication, via main flowline 33, with a formation surrounding a borehole. The apparatus 100 may include a secondary flowline 115 for purposes of a backup flowline.

In the embodiment depicted in FIG. 4A, the apparatus 100 includes a single valve apparatus 104 that interconnects the primary flowline 33 with the bypass flowline 102. The single valve apparatus 104 is situated so as to control the flow of formation fluids in the bypass flowline segment 102 of the primary flowline 33 and to isolate or capture formation fluids in the bypass flowline 102. The single valve apparatus 104 operates as a 4-way 2-position valve. In this, in one position of the single valve apparatus 104 (note FIG. 4A) a first port of the primary flowline 33 is connected with a first port of the bypass flowline 102 and a second port of the bypass flowline 102 is connected with a second port of the primary flowline 33 such that fluids flow in the primary flowline 33 via the bypass flowline 102. Note FIG. 4A. In another position of the single valve apparatus 104 (note FIG. 4A) a first port of the primary flowline 33 is connected with a second port of the primary flowline 33 and a first port of the bypass flowline 102 is connected with a second port of the bypass flowline 102 such that fluids flow in the primary flowline 33 and fluids are captured or isolated in the bypass flowline 102.

A relief valve 106 may be situated on the primary flowline 33. For example, if high pressure fluid were to be captured in the bypass flowline 102 due to failure of the valve apparatus 104 the high pressure can be released through relief valve 106 to prevent injury or safety issues after the tool returns to the surface. A check valve 121 may be provided for releasing unexpected high pressure in the primary flowline 33, for example, due to any blockage or failure in the downhole fluid analysis module. However, the relief valve 106 and the check valve 121 are not required for fluid flow control between the primary and bypass flowlines.

A pressure/temperature gauge 108 may be provided on the bypass flowline 102 to acquire pressure and/or temperature measurements of fluids in the bypass flowline 102. A density and viscosity sensor (vibrating rod) 110 also may be provided to measure characteristics of formation fluids flowing through or captured in the bypass flowline 102.

A pump unit 111 may be arranged with respect to the bypass flowline 102 to control volume and pressure of formation fluids retained in the bypass flowline 102. A scattering detector system 112 may be provided on the bypass flowline 102 to detect particles, such as asphaltene, bubbles, oil mist from gas condensate, that come out of isolated fluids in the bypass flowline 102. A circulation pump 114 is provided on the bypass flowline 102 for circulating formation fluids that are isolated in the bypass flowline 102 in a closed loop formed by the bypass flowline 102 and the single valve apparatus 104.

The bypass flowline 102 is looped, via the single valve apparatus 104, and the circulation pump 114 is provided on the looped flowline so that formation fluids isolated in the bypass flowline 102 may be circulated, for example, during phase behavior characterization. When the isolated fluid sample in the bypass flowline 102 is circulated in a closed loop line, accuracy of phase behavior measurements can be improved.

Referring to FIG. 4B, during the captured sample mode, formation fluids flow inside the primary flowline 33 with the single valve apparatus 104 in a first operating position. At this time, other fluid analysis modules analyze the characteristics of the sample flowing inside the primary flowline 33. When the sample flow becomes stable, the sample contamination is sufficiently low, and sample is single phase, the formation fluids are flowed through the bypass flowline 102 by moving the single valve apparatus 104 from the first operating position to a second operating position. Then, the sample flows into the bypass flowline 102 for a few minutes, for example, and the single valve apparatus 104 is moved to the first operating position so that sample fluid is captured or isolated in a closed loop of the bypass flowline 102 and the single valve apparatus 104.

The density and viscosity sensor 110 measures the sample density and the viscosity. The speed of the circulation pump 114 (sample flow rate) can be controlled by the surface positioned software based on the density and the viscosity measured by the density and viscosity sensor 110. Next, the circulation pump 114 is started (note FIG. 4A). Then the pump unit 111 changes the pressure of the sample captured inside the bypass flowline 102 while the pressure/temperature gauge 108 measures the pressure change and the temperature of the sample. The scattering detector 112 monitors the solid (solid precipitation from liquid or oil coming out from condensate) or gas (bubble from liquid) coming out.

In certain aspects, the circulation pump 114 works as an agitator to mix the sample inside the bypass flowline 102 and to create bubbles or solids inside the bypass flowline 102. With this function of the circulation pump 114, bubbles and solids that are generated are carried to the scattering detector 112. The pressure value is recorded when the scattering detector 112 detects the bubbles or solids.

Figure 5A:
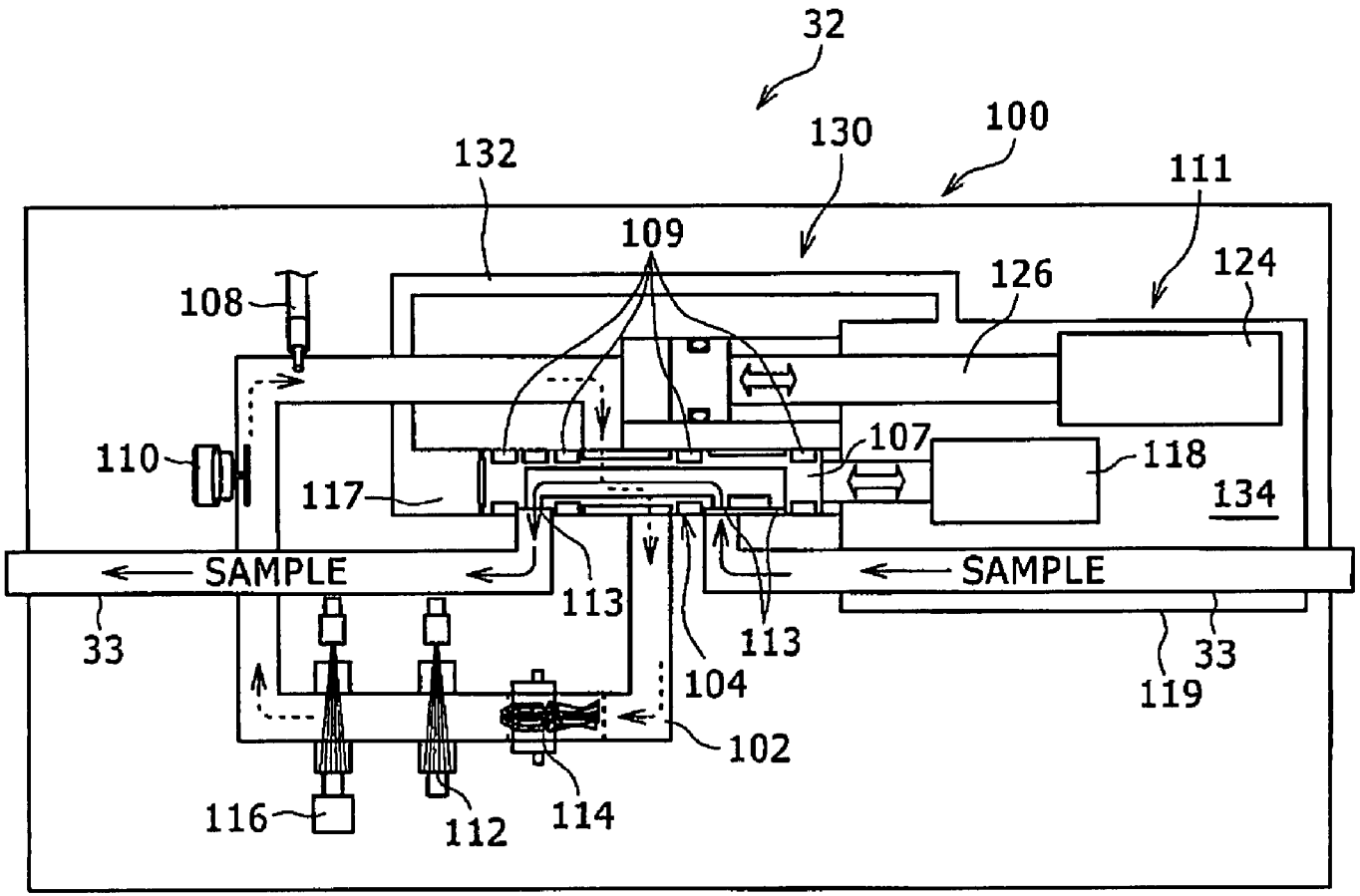
FIG. 5A illustrates schematically one fluid sampling and analysis module with a flowline and single valve apparatus configuration and a pressure compensating system according to one embodiment of the present disclosure for downhole characterization of fluids by isolating or capturing the formation fluids.
Figure 5B:
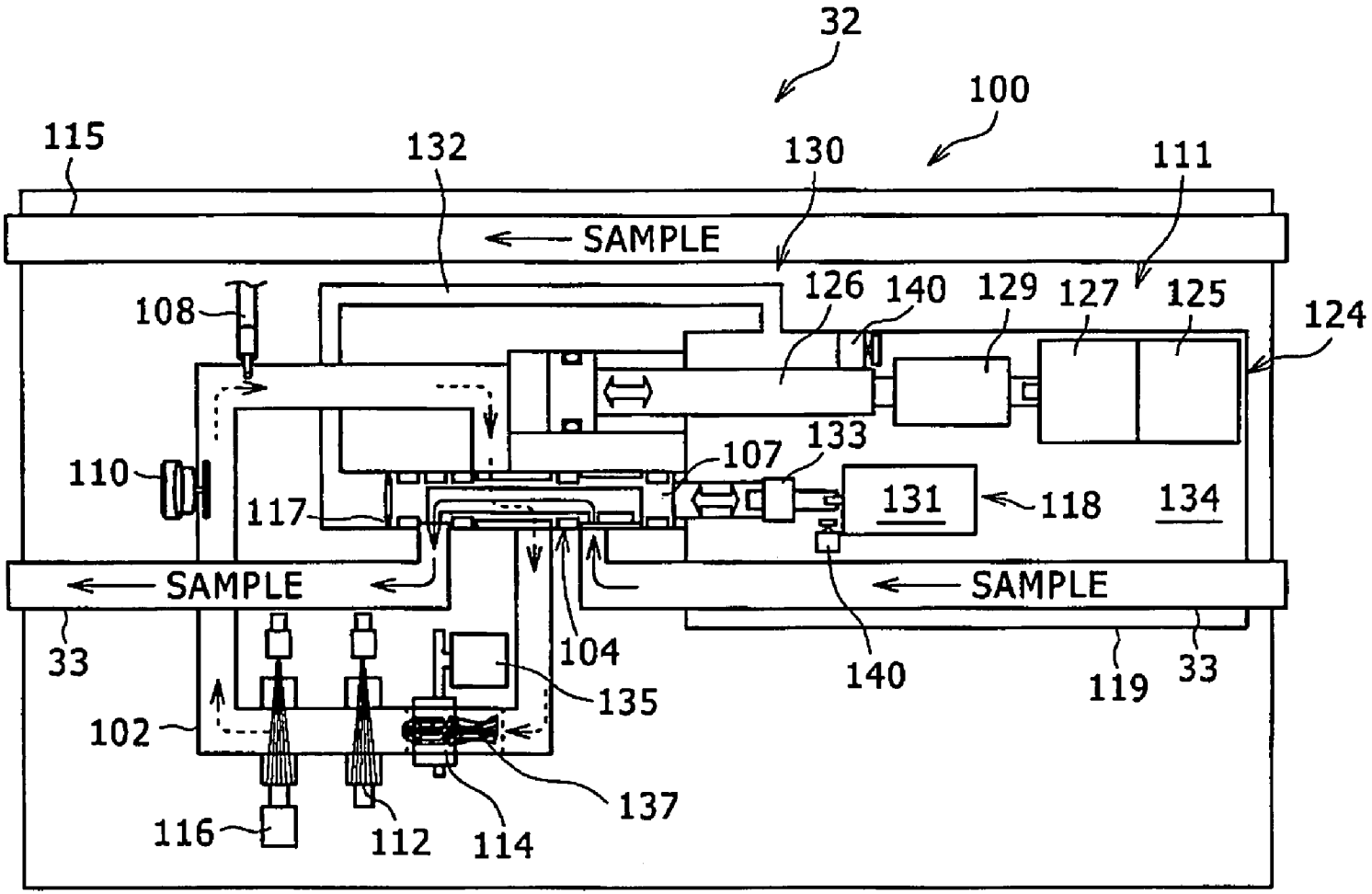
FIG. 5B illustrates schematically another fluid sampling and analysis module with a flowline and single valve apparatus configuration and a pressure compensating system according to another embodiment of the present disclosure for downhole characterization of fluids by isolating or capturing the formation fluids.

FIG. 5A is a schematic depiction of one fluid sampling and analysis module with a flowline and single valve apparatus configuration and a pressure compensating system according to one embodiment of the present disclosure for downhole characterization of fluids by isolating or capturing the formation fluids. FIG. 5B is a schematic depiction of another fluid sampling and analysis module with a flowline and single valve apparatus configuration and a pressure compensating system according to another embodiment of the present disclosure. In the apparatus of FIG. 5B, a secondary flowline 115 is provided and additional details are provided with respect to the pump 111, the valve 104, and the circulation pump 114.

Figure 5C:
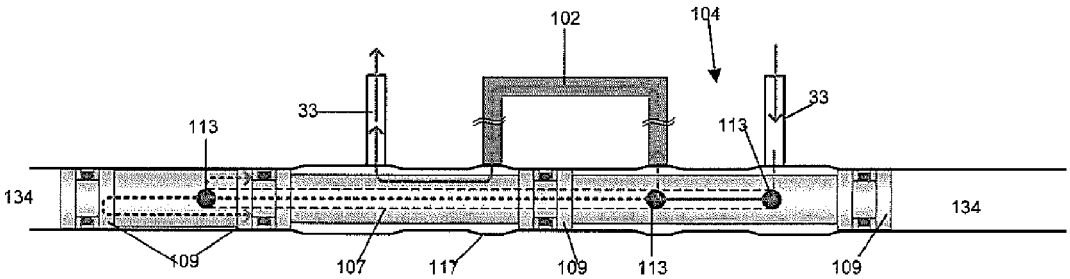
FIG. 5C illustrates schematically one flowline and single valve apparatus configuration according to one embodiment of the present disclosure for a downhole fluid sampling and analysis module.
Figure 5D:
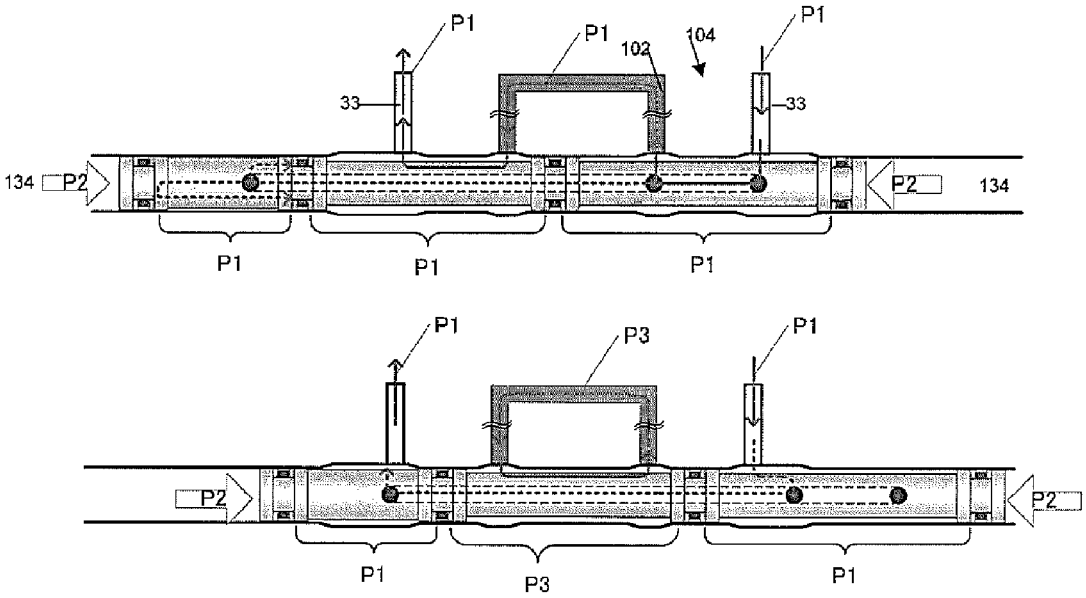
FIG. 5D illustrates schematically fluid pressure conditions for the flowline and single valve apparatus configuration of FIG. 5C according to one embodiment of the present disclosure.

FIG. 5C illustrates schematically one flowline and single valve apparatus configuration according to one embodiment of the present disclosure for a downhole fluid sampling and analysis module. FIG. 5D illustrates schematically fluid pressure conditions for the flowline and single valve apparatus configuration of FIG. 5C according to one embodiment of the present disclosure.

In addition to the elements discussed above in connection with FIG. 4A, the apparatus of FIG. 5A includes a pressure compensating system 130 having an oil line 132 that connects pressure compensation oil in a chamber 134 with a far end of the single valve 104. Note also FIGS. 6A and 6B. As depicted in FIG. 5D, fluid pressure at ends of the single valve apparatus 104 is balanced by the pressure compensation oil 134. In this, as depicted in FIG. 6B, borehole pressure is equalized with the pressure of the oil 134 of the pressure compensating system 130 so that there is no differential pressure across the valve apparatus 104 to impede movement of the valve apparatus. Moreover, balancing pressure inside the apparatus 100 with borehole pressure prevents collapse of or damage to housing 119 of the apparatus 100.

The configurations depicted in FIGS. 5A and 5B provide solutions to the issues identified above with respect to fluid flow control systems with multiple valves. In this, the single valve structure of the present disclosure eliminates the need for seal valves and simplifies the overall structure and configuration of the flowline of a sampling and analysis module. In particular, in contrast with a seal valve that is actuated by a DC motor wherein each seal valve of a fluid sampling and analysis module requires an associated motor for operation, the single valve structure of the present disclosure eliminates multiple valve and motor arrangements. By replacing seal valves with a single valve of the present disclosure, it is possible to reduce the electrical components and circuitry in the downhole sampling and analysis apparatus.

As depicted in FIGS. 5A and 5B, the apparatus includes a closed loop circulation flowline 102. In this, according to the configurations of FIGS. 5A and 5B, the dead volume of the closed loop flowline is minimized to reduce the stroke of the pump 111 for depressurization. Furthermore, length of the sampling and analysis module 100 is reduced. In contrast with the structure depicted in FIG. 7, the configurations of the flowlines of FIGS. 5A and 5B reduce the dead volume. For example, a seal valve has a dead volume of 12 cc, whereas the single valve structure of the present disclosure has a dead volume of 1.6 cc. In consequence, the single valve structure minimizes fluid dead volume in the flowline and valve of the sampling and analysis module.

The single valve structures of FIGS. 5A and 5B provide replacement of a sample that is captured in the bypass flowline through a one way flow of fluids. Therefore, the structure of the single valve minimizes residual formation fluids in the closed loop circulation flowline. The single valve has a through hole extending longitudinally through the center of a piston shaft. Sampled formation fluids flow through the through hole during sample capture in the bypass flowline 102. In this, the single valve structure eliminates the need for additional flowline hardware for formation fluids to flow through the primary flowline during sample capture in the bypass flowline.

In the embodiment depicted in FIG. 5A, the apparatus 100 includes a housing 119 and a single valve apparatus 104 that interconnects the primary flowline 33 with the bypass flowline 102. The single valve apparatus 104 is situated so as to control the flow of formation fluids in the bypass flowline segment 102 of the primary flowline 33 and to isolate or capture formation fluids in the bypass flowline 102. The single valve apparatus 104 operates as a 4-way 2-position valve. The single valve apparatus 104 includes a valve actuator 118 and a valve shaft 107 (note also FIG. 5C) having, for example, four pressure seal points 109 located on the valve shaft 107. The seal points 109 may be dynamic seals that are disposed on the valve shaft 107 and move with the shaft in valve housing 117. The valve shaft 107 has a center through hole and three side holes or orifices 113. The holes are in fluid connection with each other and with an annular space between the valve shaft 107 and the inner wall of the valve housing 117. Note also FIG. 5C.

In one position of the single valve apparatus 104 (note FIG. 5A) a first port of the primary flowline 33 is connected with a second port of the primary flowline 33 and a first port of the bypass flowline 102 is connected with a second port of the bypass flowline 102 such that fluids flow in the primary flowline 33 and fluids are captured or isolated in the bypass flowline 102. Note FIG. 5A. In another position of the single valve apparatus 104 a first port of the primary flowline 33 is connected with a first port of the bypass flowline 102 and a second port of the primary flowline 33 is connected with a second port of the bypass flowline 102 (note FIG. 5C) such that such that fluids flow in the primary flowline 33 via the bypass flowline 102. As evident from FIG. 5C, the inner wall of the valve housing 117 is contoured or shaped so that, in combination with the seal points 109 and orifices 113 fluid flow is maintained in the primary flowline 33 and the bypass flowline 102 during movement or operation of the single valve apparatus between the two above mentioned positions.

A pressure/temperature gauge 108 may be provided on the bypass flowline 102 to acquire pressure and/or temperature measurements of fluids in the bypass flowline 102. A density and viscosity sensor (vibrating rod) 110 also may be provided to measure characteristics of formation fluids flowing through or captured in the bypass flowline 102.

A pump unit 111 may be arranged with respect to the bypass flowline 102 to control volume and pressure of formation fluids retained in the bypass flowline 102. The pump unit 111 has a piston actuator 124 that drives pump piston 126. A scattering detector system 112 may be provided on the bypass flowline 102 to detect particles, such as asphaltene, bubbles, oil mist from gas condensate, that come out of isolated fluids in the bypass flowline 102. A circulation pump 114 is provided on the bypass flowline 102 for circulating formation fluids that are isolated in the bypass flowline 102 in a closed loop formed by the bypass flowline 102 and the single valve apparatus 104. An imager 116, such as charge couple device or a CMOS, may be provided on the bypass flowline 102 to image fluid flowing in the bypass flowline 102.

The bypass flowline 102 is looped, via the single valve apparatus 104, and the circulation pump 114 is provided on the looped flowline so that formation fluids isolated in the bypass flowline 102 may be circulated, for example, during phase behavior characterization. When the isolated fluid sample in the bypass flowline 102 is circulated in a closed loop line, accuracy of phase behavior measurements can be improved.

FIG. 5B is a schematic depiction of another fluid sampling and analysis module with a flowline and single valve apparatus configuration and a pressure compensating system according to another embodiment of the present disclosure. In the apparatus of FIG. 5B, a secondary flowline 115 is provided and additional details are provided with respect to the pump 111, the valve 104, and the circulation pump 114. For example, the pump unit 111 may have a piston actuator 124 that drives pump piston 126. The actuator unit 124 may include an encoder 125 for monitoring rotations of, for example, a stepper motor 127 that is connected with, for example, a ball screw and nut assembly 129, which converts rotary motion of the motor 127 to longitudinal motion of the pump piston 126. In one embodiment of the present disclosure, the valve actuator 118 may comprise a brushless DC motor 131 that is connected with a ball screw and nut assembly 133 for controlling movement and position of the single valve apparatus 104. Position switches 140 may be provided to monitor positions of the pump shaft 126 and the valve shaft 107. In combination the aforementioned elements of the pump actuator unit 124 and the valve actuator 118 may be utilized for controlling movement and position of the piston 126 of the pump unit 111 and the valve shaft 107 of the single valve apparatus 104.

In some embodiments, the circulation pump 114 may include a brushless DC motor 135 and a magnet coupler and impeller 137, as described in detail in aforementioned U.S. patent application Ser. No. 11/858,138, previously incorporated herein by reference.

Although the exemplary embodiments depicted in FIGS. 5A and 5B show two actuators for the pump unit 111 and the single valve apparatus 104, the present disclosure contemplates an actuating system having a single actuator for both the pump unit 111 and the valve apparatus 104. In this, an actuating system having a single motor, for example, a brushless DC motor, with a suitable clutch connector assembly connected with the motor would provide drive and control functions for both pump unit 111 and the valve apparatus 104. For example, a suitable clutch mechanism maintains position of the valve shaft 107 while sample fluids are replaced in the bypass flowline (note FIG. 6B, Step 1). Then, the single motor releases the clutch so that the valve shaft 107 changes its position to the sample capturing position (note FIG. 6B, Step 2). Next, the clutch holds the position until the next sample replacing sequence. While the valve shaft 107 is moved from the sample replacing position to the sample capturing position, another mechanism causes the pump shaft 126 to move backward so that space for pressurization is created in the pump unit 111. After sample capture, the mechanism moves the pump shaft 126 forward to pressurize the captured fluids in the bypass flowline, and then moves the pump shaft backward to depressurize the captured fluids (note FIG. 6B, Step 3). By use of a suitable clutch system it is possible to decouple the piston of the pump 111 and the valve shaft 107 while using a single motor. Moreover, movement of the pump piston 126 may be varied to a pressurize/depressurize configuration instead of a single depressurization movement. In this, it is possible to draw fluids into the bypass flowline, move the pump piston 126 in a forward direction to pressurize the captured fluids in the bypass flowline, and then move the pump piston 126 in a backward direction to depressurize the captured fluids in the bypass flowline. An actuating system with a single motor and a clutch system would utilize less space and require less power than a two actuator system depicted in FIGS. 5A and 5B. However, the present disclosure contemplates use of both types of actuating systems.

Figure 6A:
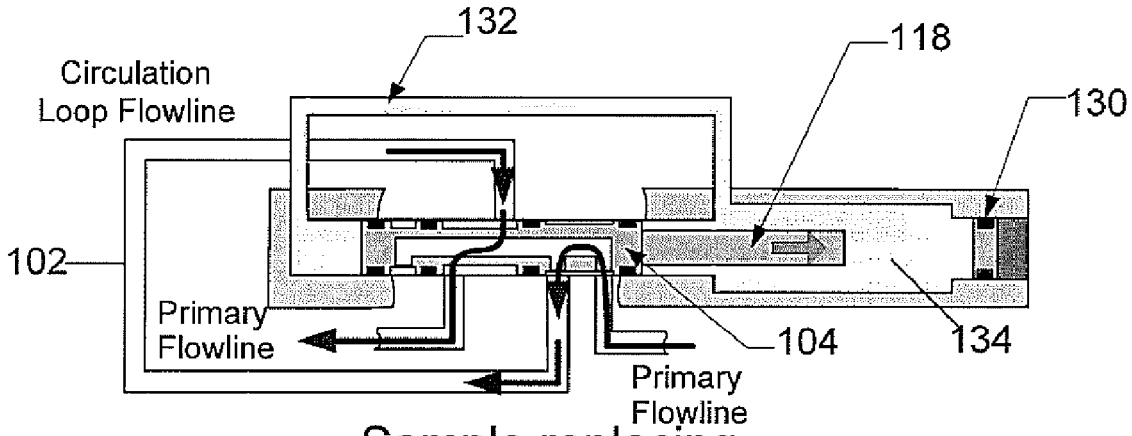
FIG. 6A is a schematic depiction of the operations of a flowline and single valve apparatus configuration and pressure compensating system according to one embodiment of the present disclosure.
Figure 6A:
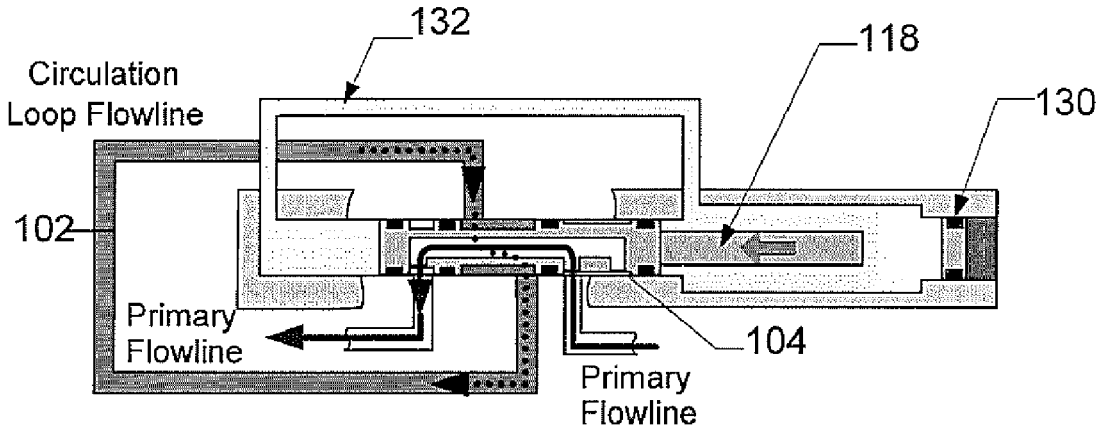
Figure 6B:
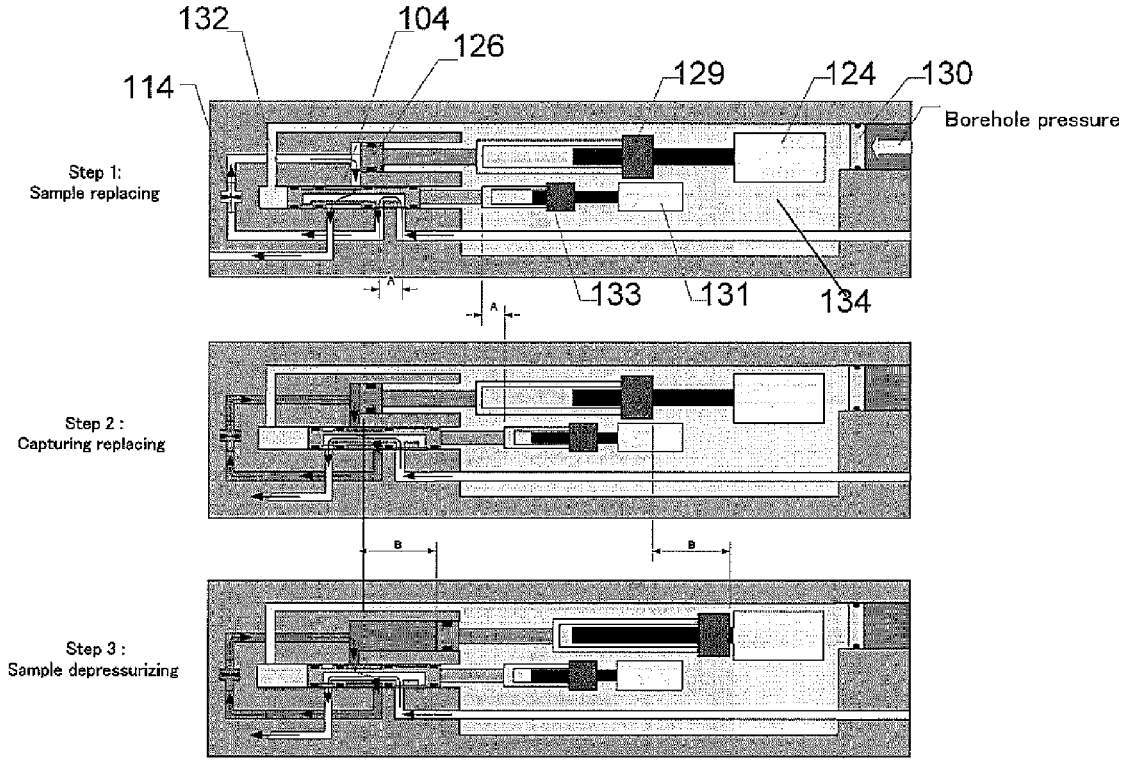
FIG. 6B is a schematic depiction of the step-by-step operations of a flowline and single valve apparatus configuration and pressure compensating system according to one embodiment of FIG. 6A.

FIG. 6A is a schematic depiction of the operations of a flowline and single valve apparatus configuration and pressure compensating system according to one embodiment of the present disclosure. As previously discussed above in connection with FIG. 4B, during the captured sample mode, formation fluids flow inside the primary flowline 33 with the single valve apparatus 104 in a first operating position. At this time, other fluid analysis modules analyze the characteristics of the sample flowing inside the primary flowline 33. When the sample flow becomes stable, the sample contamination is sufficiently low, and sample is single phase, the formation fluids are flowed through the bypass flowline 102 by moving the single valve apparatus 104 from the first operating position to a second operating position. Then, the sample flows into the bypass flowline 102 for a few minutes, for example, and the single valve apparatus 104 is moved to the first operating position so that sample fluid is captured or isolated in a closed loop of the bypass flowline 102 and the single valve apparatus 104.

FIG. 6B is a schematic step-by-step depiction of the operations of a flowline and single valve apparatus configuration and pressure compensating system according to the present disclosure. Referring also to FIG. 5A, the single valve 104 has a longitudinal valve shaft 107 that is movable in valve housing 117. Four pressure seal points 109, for example, dynamic seals are located on the valve shaft 107 and move with the shaft. The valve shaft 107 has a center through hole and three side holes or orifices 113. The holes are in fluid connection with each other. As evident from FIG. 5C, the inner wall of the valve housing 117 is contoured so that fluid flow in the primary flowline 33 and the bypass flowline 102 is not interrupted during movement of the valve shaft 107 from sample captured to sample replacing and vice versa. An actuator 118 is connected with the valve shaft 107 so as to move the valve shaft 107 in the housing 117 of the valve such that the position of the valve shaft 107 relative to the valve housing 117 is changed.

Referring to FIG. 6B, for replacing the fluid in the bypass flowline, formation fluids flowing in the primary flowline are diverted to the bypass flowline. The formation fluids enter the loop of the bypass flowline and then return to the primary flowline. In this, a closed loop circulation flowline is provided by the interconnection of the single valve and the bypass flowline. Since the formation fluids reenter the primary flowline at the other end of the bypass flowline, sampled or captured fluids in the bypass flowline are replaced with fresh formation fluids.

The single valve system disclosed herein provides a closed loop circulation flowline for formation fluids that are isolated from the fluids in the primary flowline to undergo pressure changes in the circulation flowline. In this, the single valve 104 provides circulation of captured fluids in the bypass flowline 102 without interrupting fluid flow in the primary flowline 33. A pressure balancing oil 134 (note FIG. 6A) is provided on both sides of the single valve piston shaft. The oil is in fluid communication with a pressure compensator system 130 to balance the pressure in the valve. Therefore, if pressure in the primary flowline fluctuates, or the pressure in the circulation flowline changes, the valve piston shaft can maintain its position relative to the housing of the single valve. An actuating force of 20 kgf is required for actuating the piston shaft of the single valve, which is sufficient to overcome the friction of the dynamic seals of the single valve.

Figure 7:
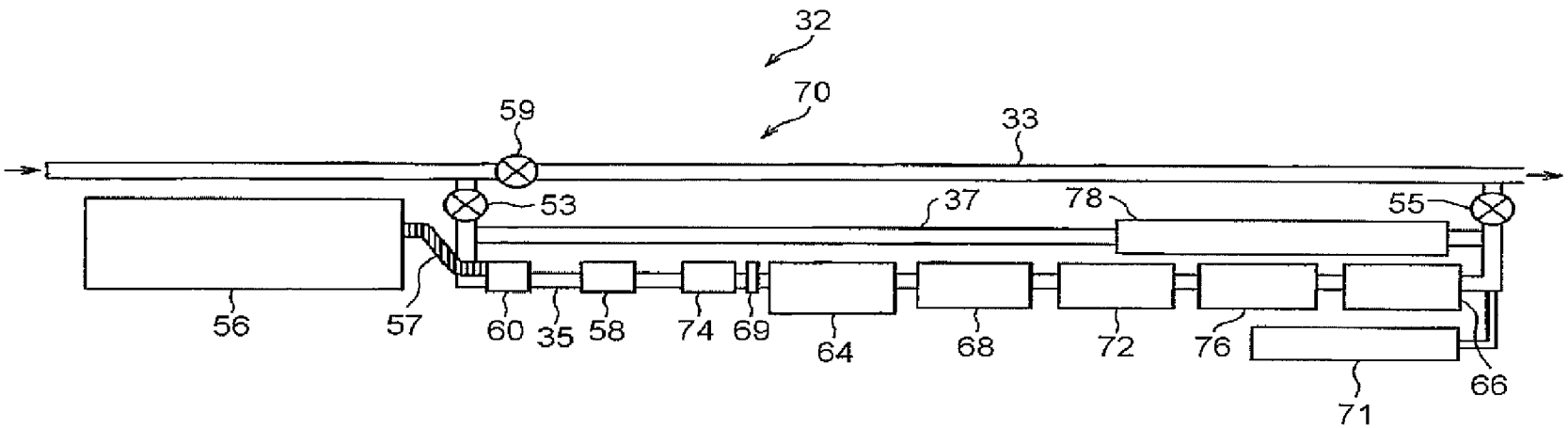
FIG. 7 schematically represents an example of a fluid sampling and analysis module with a flowline and multiple valve configuration for downhole characterization of fluids by isolating or capturing the formation fluids.

FIG. 7 schematically represents an example of a fluid sampling and analysis module 32 with a flowline and multiple valve apparatus 70 for downhole characterization of fluids by isolating or capturing the formation fluids. Detailed description of the apparatus of FIG. 7 may be found in co-pending and commonly owned U.S. patent application Ser. No. 11/203,932, filed Aug. 15, 2005, entitled "Methods and Apparatus of Downhole Fluid Analysis", which discloses the use of a plurality of valves for isolating formation fluids in a part of the flowline of a downhole sampling and analysis module, and previously incorporated herein by reference.

The apparatus 70 includes a bypass flowline 35 and a circulation flowline 37 in fluid communication, via main flowline 33, with a formation surrounding a borehole. In FIG. 7, the apparatus 70 includes two seal valves 53 and 55 operatively associated with the bypass flowline 35. The valves 53 and 55 are situated so as to control the flow of formation fluids in the bypass flowline segment 35 of the main flowline 33 and to isolate formation fluids in the bypass flowline 35 between the two valves 53 and 55. A valve 59 may be situated on the main flowline 33 to control fluid flow in the main flowline 33. For example, each of the seal valves 53 and 55 may have an electrically operated DC brushless motor or stepping motor with an associated piston arrangement for opening and closing the valve.

One or more optical sensors, such as a 36-channels optical spectrometer 56, connected by an optical fiber bundle 57 with an optical cell or refractometer 60, and/or a fluorescence/refraction detector 58, may be arranged on the bypass flowline 35, to be situated between the valves 53 and 55. The optical sensors may be used to characterize fluids flowing through or retained in the bypass flowline 35. U.S. Pat. Nos. 5,331,156 and 6,476,384, and U.S. Patent Application Publication No. 2004/0000636A1 (all incorporated herein by reference in their entirety) disclose methods of characterizing formation fluids.

A pressure/temperature gauge 64 and/or a resistance sensor 74 also may be provided on the bypass flowline 35 to acquire fluid electrical resistance, pressure and/or temperature measurements of fluids in the bypass flowline 35 between seal valves 53 and 55. A chemical sensor 69 may be provided to measure characteristics of the fluids, such as CO2, H2S, pH, among other chemical properties. An ultra sonic transducer 66 and/or a density and viscosity sensor (vibrating rod) 68 also may be provided to measure characteristics of formation fluids flowing through or captured in the bypass flowline 35 between the valves 53 and 55. U.S. Pat. No. 4,860,581, incorporated herein by reference in its entirety, discloses apparatus for fluid analysis by downhole fluid pressure and/or electrical resistance measurements. U.S. Pat. No. 6,758,090 and Patent Application Publication No. 2002/0194906A1 (both incorporated herein by reference in their entirety) disclose methods and apparatus of detecting bubble point pressure and MEMS based fluid sensors, respectively.

A pump unit 71, such as a syringe-pump unit, may be arranged with respect to the bypass flowline 35 to control volume and pressure of formation fluids retained in the bypass flowline 35 between the valves 53 and 55. A detailed description of the pump unit 71 is provided in the aforementioned U.S. patent application Ser. No. 11/203,932, previously incorporated herein by reference.

An imager 72, such as a CCD camera, may be provided on the bypass flowline 35 for spectral imaging to characterize phase behavior of downhole fluids isolated therein, as disclosed in co-pending U.S. patent application Ser. No. 11/204,134, titled "Spectral Imaging for Downhole Fluid Characterization," filed on Aug. 15, 2005.

A scattering detector system 76 may be provided on the bypass flowline 35 to detect particles, such as asphaltene, bubbles, oil mist from gas condensate, that come out of isolated fluids in the bypass flowline 35. A circulation pump 78 is provided on the circulation flowline 37. A detailed description of the circulation pump 78 is provided in the aforementioned U.S. patent application Ser. No. 11/858,138, previously incorporated herein by reference.

Since the circulation flowline 37 is a loop flowline of the bypass flowline 35, the circulation pump 78 may be used to circulate formation fluids that are isolated in the bypass flowline 35 in a loop formed by the bypass flowline 35 and the circulation flowline 37.

The preceding description has been presented only to illustrate and describe the invention and some examples of its implementation. It is not intended to be exhaustive or to limit the invention to any precise form disclosed. Many modifications and variations are possible in light of the above teaching. The aspects herein were chosen and described in order to best explain principles of the invention and its practical applications. The preceding description is intended to enable others skilled in the art to best utilize the invention in various embodiments and aspects and with various modifications as are suited to the particular use contemplated. It is intended that the scope of the invention be defined by the following claims.

What is claimed is:

1. A downhole apparatus for characterizing fluids withdrawn from a formation, comprising:

a primary flowline for conveying the fluids therein, the primary flowline comprising a first end for allowing the fluids to enter and a second end for allowing the fluids to exit;

a bypass flowline in fluid communication with the primary flowline, the bypass flowline comprising a first port for allowing the fluids to enter and a second port for allowing the fluids to exit, and the first and second ports of the bypass flowline being separated;

a fluid control system interconnecting the primary flowline and the bypass flowline, the fluid control system having a single valve assembly with a first position interconnecting the first end of the primary flowline with the second end of the primary flowline, such that the fluids flow directly in the primary flowline, and a second position interconnecting the first end of the primary flowline with the first port of the bypass flowline, and interconnecting the second end of the primary flowline with the second port of the bypass flowline, such that the fluids flow, via the bypass flowline, in the primary flowline; and a circulation pump for circulating the fluids in the closed loop of the circulation flowline, wherein the first position of the fluid control system forms a circulation flowline to capture and to circulate the fluids in a closed loop.

2. A downhole apparatus for characterizing fluids withdrawn from a formation, comprising:

a primary flowline for conveying the fluids therein, the primary flowline comprising a first end for allowing the fluids to enter and a second end for allowing the fluids to exit;

a bypass flowline in fluid communication with the primary flowline, the bypass flowline comprising a first port for allowing the fluids to enter and a second port for allowing the fluids to exit, and the first and second ports of the bypass flowline being separated;

a fluid control system interconnecting the primary flowline and the bypass flowline, the fluid control system having a single valve assembly with a first position interconnecting the first end of the primary flowline with the second end of the primary flowline, such that the fluids flow directly in the primary flowline, and a second position interconnecting the first end of the primary flowline with the first port of the bypass flowline, and interconnecting the second end of the primary flowline with the second port of the bypass flowline, such that the fluids flow, via the bypass flowline, in the primary flowline; and at least one first sensor structured and arranged for measuring parameters of interest downhole, wherein the first position of the fluid control system forms a circulation flowline to capture and to circulate the fluids in a closed loop, wherein the parameters of interest relate to the fluids in the circulation flowline, and wherein the at least one first sensor comprising one or more of a density/viscosity sensor, a pressure sensor, and an imager.

3. A downhole apparatus for characterizing fluids withdrawn from a formation, comprising:

a primary flowline for conveying the fluids therein, the primary flowline comprising a first end for allowing the fluids to enter and a second end for allowing the fluids to exit;

a bypass flowline in fluid communication with the primary flowline, the bypass flowline comprising a first port for allowing the fluids to enter and a second port for allowing the fluids to exit, and the first and second ports of the bypass flowline being separated;

a fluid control system interconnecting the primary flowline and the bypass flowline, the fluid control system having a single valve assembly with a first position interconnecting the first end of the primary flowline with the second end of the primary flowline, such that the fluids flow directly in the primary flowline, and a second position interconnecting the first end of the primary flowline with the first port of the bypass flowline, and interconnecting the second end of the primary flowline with the second port of the bypass flowline, such that the fluids flow, via the bypass flowline, in the primary flowline; and a pressure compensation unit associated with the fluid control system, the pressure compensation unit being structured and arranged for balancing pressure at opposite ends of the fluid control system to borehole pressure.

4. A downhole apparatus for characterizing fluids withdrawn from a formation, comprising:

a primary flowline for conveying the fluids therein, the primary flowline comprising a first end for allowing the fluids to enter and a second end for allowing the fluids to exit;

a bypass flowline in fluid communication with the primary flowline, the bypass flowline comprising a first port for allowing the fluids to enter and a second port for allowing the fluids to exit, and the first and second ports of the bypass flowline being separated;

a fluid control system interconnecting the primary flowline and the bypass flowline, the fluid control system having a single valve assembly with a first position interconnecting the first end of the primary flowline with the second end of the primary flowline, such that the fluids flow directly in the primary flowline, and a second position interconnecting the first end of the primary flowline with the first port of the bypass flowline, and interconnecting the second end of the primary flowline with the second port of the bypass flowline, such that the fluids flow, via the bypass flowline, in the primary flowline; and a plurality of sensors structured and arranged for measuring parameters of interest relating to fluids withdrawn from the formation.

5. The downhole fluid characterization apparatus according to claim 4, wherein the first position of the fluid control system forms a circulation flowline to capture and to circulate the fluids in a closed loop.

6. The downhole fluid characterization apparatus according to claim 5, further comprising:

a pump unit in fluid communication with the bypass flowline for varying pressure and volume of the fluids.

7. The downhole fluid characterization apparatus according to claim 4, wherein the first and second positions are linearly positioned, and wherein the single valve assembly is movable between the first and second positions.

8. A downhole apparatus for characterizing fluids withdrawn from a formation, comprising:

a primary flowline for conveying the fluids therein, the primary flowline comprising a first end for allowing the fluids to enter and a second end for allowing the fluids to exit;

a bypass flowline in fluid communication with the primary flowline, the bypass flowline comprising a first port for allowing the fluids to enter and a second port for allowing the fluids to exit, and the first and second ports of the bypass flowline being separated; and a fluid control system interconnecting the primary flowline and the bypass flowline, the fluid control system having a single valve assembly with a first position interconnecting the first end of the primary flowline with the second end of the primary flowline, such that the fluids flow directly in the primary flowline, and a second position interconnecting the first end of the primary flowline with the first port of the bypass flowline, and interconnecting the second end of the primary flowline with the second port of the bypass flowline, such that the fluids flow, via the bypass flowline, in the primary flowline, wherein the fluid control system comprises:

a shaft structured and arranged for longitudinal movement in a housing;

the shaft having a through hole extending longitudinally and three orifices;

an annular space between the shaft and the housing, and four seals attached to the shaft in the annular space between the shaft and the housing, wherein the shaft and the inner wall of the housing being shaped so that in combination with the three orifices, through hole and annular space between the shaft and the housing fluid flow in the primary flowline is not blocked during operation of the fluid control system between the first position and the second position.

9. A downhole tool for sampling and characterizing fluids in an oilfield reservoir, comprising:

a flowline for conveying the fluids therein, the flowline having a first end for allowing the fluids to enter and a second end for allowing the fluids to exit, the flowline comprising a primary flowline and a bypass flowline;

a single valve interconnecting the primary flowline and the bypass flowline, the single valve being operable to a first position for the fluids to flow directly in the primary flowline, and to a second position for formation fluids to flow, via the bypass flowline, in the primary flowline, wherein:

the bypass flowline comprises a closed loop flowline for capturing the fluids when the single valve is in the first position; and a pressure compensation unit structured and arranged for balancing pressure at opposite ends of the valve so that operation of the single valve between the first and the second positions is at a balanced borehole pressure.

10. The tool according to claim 9, wherein fluid flow in the primary flowline is maintained during operation of the single valve between the first and the second positions.

11. A method of downhole characterization of formation fluids utilizing a downhole tool comprising a primary flowline, a bypass flowline, and a single valve for selectively interconnecting the primary flowline and the bypass flowline for control of flowing formation fluids and for capturing the formation fluids in a closed loop of the bypass flowline, the method comprising:

setting the single valve in a first operating position so that the formation fluids flow through the primary flowline;

monitoring at least a first parameter of interest relating to formation fluids flowing in the primary flowline;

when a predetermined criterion for the first parameter of interest is satisfied, setting the single valve in a second operating position so that formation fluids flow, via the bypass flowline, in the primary flowline;

capturing the formation fluids in the closed loop of the bypass flowline by returning the valve to the first operating position;

balancing pressure at opposite ends of the single valve so that operation of the single valve between the first and the second operating positions is at a balanced fluid pressure; and characterizing the captured formation fluids by operation of one or more sensors structured and arranged on the bypass flowline.

12. The method of downhole characterization of formation fluids according to claim 11, wherein characterizing the captured formation fluids includes determining one or more fluid property of the captured formation fluids.

13. The method of downhole characterization of formation fluids according to claim 12, wherein determining one or more fluid property comprises changing fluid pressure of the captured formation fluids by varying volume of the captured formation fluids before determining one or more fluid property.

14. The method of downhole characterization of formation fluids according to claim 13, wherein the one or more fluid property determined after changing fluid pressure includes one or more of fluid compressibility, asphaltene precipitation onset, bubble point and dew point.

15. The method of downhole characterization of formation fluids according to claim 11, further comprising:

circulating the captured formation fluids in the closed loop of the bypass flowline while characterizing the captured formation fluids.

16. The method of downhole characterization of formation fluids according to claim 15, wherein characterizing the captured formation fluids includes determining phase behavior of the formation while circulating the captured formation fluids in the closed loop.

* * * * *